US006517070B1

(12) United States Patent
Clapera

(10) Patent No.: US 6,517,070 B1
(45) Date of Patent: Feb. 11, 2003

(54) DOMINO

(76) Inventor: Joan Fornesa Clapera, Avenida Josep Tarradellas, 151, E-08029 Barcelona (ES)

( * ) Notice: Subject to any disclaimer, the term of this patent is extended or adjusted under 35 U.S.C. 154(b) by 0 days.

(21) Appl. No.: 09/719,524

(22) PCT Filed: Apr. 13, 2000

(86) PCT No.: PCT/ES00/00135

§ 371 (c)(1),
(2), (4) Date: Apr. 6, 2001

(87) PCT Pub. No.: WO00/61250

PCT Pub. Date: Oct. 19, 2000

(30) Foreign Application Priority Data

Apr. 13, 1999 (ES) ..... 9900765
May 10, 1999 (ES) ..... 9900967

(51) Int. Cl.[7] ..... A63F 9/20; A63F 1/10

(52) U.S. Cl. ..... 273/148 A; 273/148 R; 273/293; 273/289; 273/288; D21/392; D21/391

(58) Field of Search ..... 273/293, 148 A, 273/292, 148 R, 289, 290, 288, 280, 282.1; D21/392, 391

(56) References Cited

U.S. PATENT DOCUMENTS 1,185,936 A * 6/1916 Ramsey
1,549,095 A * 8/1925 Levine
1,571,374 A 2/1926 Richard
2,253,823 A * 8/1941 Suteras
2,932,518 A * 4/1960 Burros
3,826,500 A 7/1974 Stratta
3,827,695 A * 8/1974 Hess ..... 273/293
4,083,564 A * 4/1978 Matsumoto
4,257,611 A 3/1981 Schmitz
4,705,275 A * 11/1987 Slater
5,016,889 A * 5/1991 Moss et al.
5,478,085 A * 12/1995 Canner et al. ..... 273/239
6,168,156 B1 * 1/2001 Gonzalez ..... 273/148 A

FOREIGN PATENT DOCUMENTS

DE 293152 * 11/1915
FR 1171376 * 9/1960
FR 1443122 * 5/1966
SU 1 747 113 A1 7/1926

* cited by examiner

*Primary Examiner*—Benjamin H. Layno
(74) *Attorney, Agent, or Firm*—Michael J. Striker

(57) ABSTRACT

A domino including pieces (1) which have on their back or sides an indication device with several identifying positions, and a device for storing and transporting the same. The indication device provided on the back of the pieces allows the pieces corresponding to each player to be marked so as to carry out the same distribution in other matches. The device for storing and transporting the pieces (1) is made up of four cases (9) which have means to allow them to be identified or for the indication device of the pieces (1) housed in each of them to be viewed.

20 Claims, 2 Drawing Sheets

DOMINO

BACKGROUND OF THE INVENTION

The present invention refers, as its title indicates, to an improved domino.

BACKGROUND OF THE INVENTION

Everybody knows the game of dominoes, which has twenty-eight pieces consisting of all the combinations of pairs of points, between the double zero and the double six, and normally represented by dots on its obverse.

Apart from being easy to play, figures have been adopted in other variants of the game so that it can be learned by young children.

The features of the game consist of it being played with two opposing pairs of players each of whom have to place as many of their pieces as possible which coincide with the ends of the row, and at the same time prevent the opposite pair from placing their own.

The drawback encountered by players in domino championship matches is that there is no playing procedure which is impartial, since until now chance has decided the distribution of pieces among the players in each match, without allowing their value to be compared between one player and another.

In the case of a "pool" type championship, that is, all the participating tables play the same groups of pieces, distributed in the same arrangement, the drawback arises that at the end of a match it is not possible to locate the pieces corresponding to each player, unless their values are noted on a sheet of paper.

Sometimes, even though a championship is not being played, one may also wish to repeat matches with the same distribution of pieces, either to improve the score or to make comparisons or small contests between different players.

Placing of the pieces at the start of a match is also a drawback to be taken into account, as they must be placed standing up on the playing table without being visible by the other players.

Another drawback, which arises at the end of a match, is the nuisance entailed by having to place all the pieces inside the traditional box.

SUMMARY OF THE INVENTION

The domino pieces proposed by the invention have been conceived and structured in order to resolve these problems, as it provides for the possibility that all the domino players, for example in a championship, possess the same pieces in each match, and distributed in the same arrangement as the previous four players had, that is, that the four players who make up the match, identified, for example, as north-south-east-west (N-S-E-W), (1-2-3-4), (red-green-yellow-blue), etc., receive the same seven pieces which their predecessors received, thus eliminating the distorting effect of chance in the competition and making it possible to establish a fairer comparison among all the participants.

This is achieved by identifying the pieces of each player on their back or sides, in such a way that once the match is over, the pieces belonging to each are recovered, locating the signal that was arranged, for example, in the first distribution and being able to replay the same match or establish a priori some predetermined combinations.

The device for storing, moving and identifying the pieces, has appropriate elements for facilitating location, possession, movement and keeping of the pieces in a perfectly suitable way, as it consists mainly of a group of four cases which also serve as a support for the seven pieces corresponding to each of the four players.

Once the domino pieces are identified, their location in each case may be organised. To allow identification of the pieces contained in each case, the latter have been provided with the possibility of having windows or transparencies in which the marks of the pieces can be seen, or each case is identified by letters, signs, numbers, colors, etc.

In this way, if we indicate each player as north-south-east-west (or blue-green-yellow-red, etc.), each group of seven pieces is respectively located.

Each of these four cases, in which seven pieces must be placed, may be made of a material which leaves visible only the backs of the pieces in order to observe if they correspond to those which were previously marked, or it may be an opaque material so that each one identifies one of the four players.

It must also be observed that the arrangement of the pieces is correct, that is, that all the scores are concealed and that the sides, for example, are shown which show the two identifying colours of the obverse and the back of the pieces.

These four cases may also be arranged inside a box or tray for moving or keeping the entire domino match, as well as for storing the same.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

In the light of these figures it may be observed that the proposed domino pieces are structured on the basis of the traditional pieces, and that on their back and/or sides indication devices have been provided with the four possible alternatives for identifying them, in such a way that by a simple rotation, sliding or turning movement they can be identified.

Figure 1:
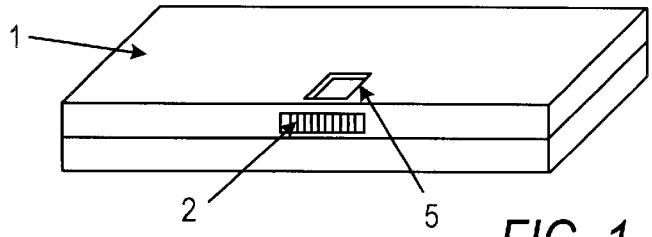
FIG. 1.—shows a perspective view of the back of a domino piece with a type of circular indication.
Figure 2:
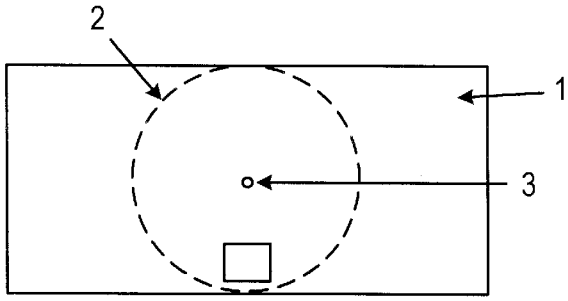
FIG. 2.—shows a detail in plan view of the unit represented in the foregoing figure.

FIG. 1. Shows a domino piece (1) in which an inner disc (2) has been incorporated which turns on an axle (3) which starts at the same spigot located on its obverse. Engraved on this disc are four possible positions [N]-[S]-[E]-[W] such that as it turns one of them coincides with a mark made for this purpose or appears in the window (5).

Figure 3:
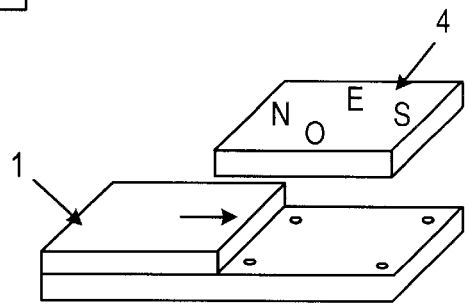
FIG. 3.—shows the back of a domino piece, from which a portion is detached.

It can be provided, as shown in FIG. 3, that a portion (4) of the piece, in this case half of the surface of the back may be detached from the rest of the piece, in such a way that each of the four possible positions or possibilities of placement identifies each of the four cardinal points represented by either its initial or numbers, letters or other signs or colors.

Figure 4:
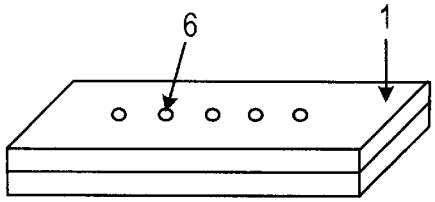
FIG. 4.—shows the back of a domino piece in which holes have been made.
Figure 5:
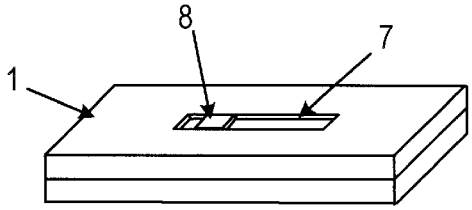
FIG. 5.—shows the back of a domino piece with a slot in which a flange slides.

FIGS. 4 and 5 show other examples of the infinite possibilities of marking, such as a slot (7) in the case of FIG. 5, in which a flange (8) slides, or as in FIG. 4, holes (6) which can be occupied by identifying pegs.

All of these may have a fifth neutral identifying place to be used in cases in which indication is not desired.

Figure 6:
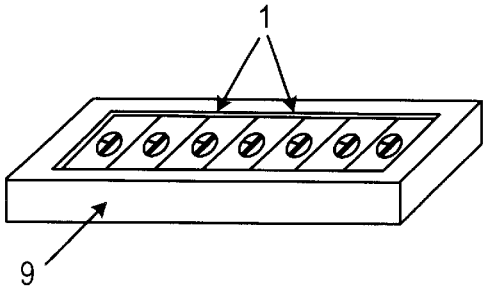
FIG. 6.—shows a perspective view of a case which contains seven domino pieces.

FIG. 6 shows a case (9) without a lid, in the form of a tray, where the seven pieces (1) are located in such a way that their backs, and therefore the means of identifying them, are visible.

Figure 7:
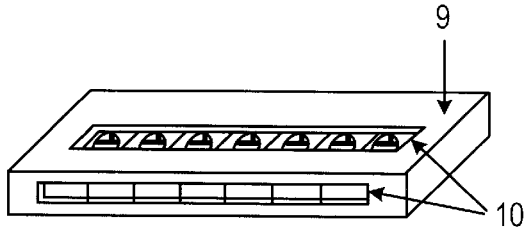
FIG. 7.—shows a perspective view of a case with windows.

FIG. 7 shows a case (9) with apertures (10) which allow the identifying marks of the pieces (1) placed inside it to be viewed.

Figure 8:
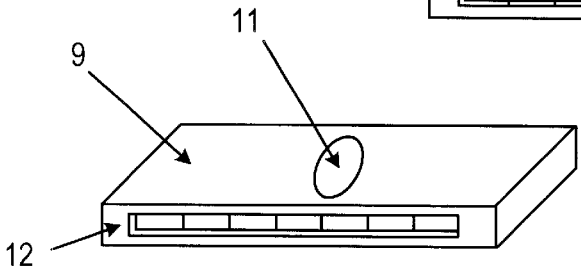
FIG. 8.—shows a case in which one can observe a reference indication on its outside.
Figure 9:
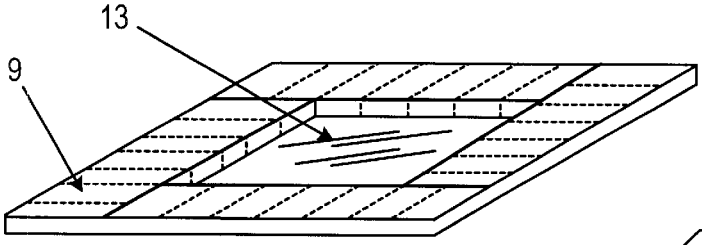
FIG. 9.—shows a tray containing the four cases of domino pieces.

The case (9) represented in FIG. 8 is opaque and does not allow one to distinguish the obverse, nor the back, nor the sides of the domino pieces (1) kept inside it, but by means of the reference (11) or the colour of the same the case in question may be identified from among the four. On one side (12) of the case (9) one can observe whether the pieces are well placed, that is, with the back facing upwards.

Figure 10:
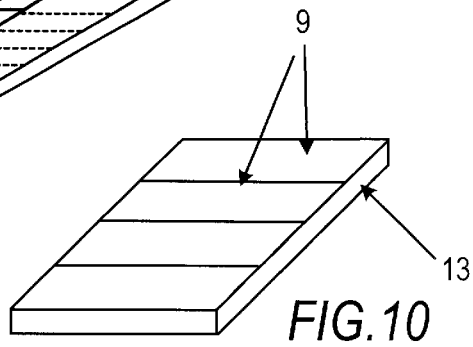
FIGS. 10 and 11.—show two boxes containing the four cases.

The purpose of the tray (13) is to place upon it an entire domino match for moving and storage. It can be designed for placing the cases (9) in quincunxes, as may be observed in figure (9), or laterally as shown in FIG. 10.

Figure 11:
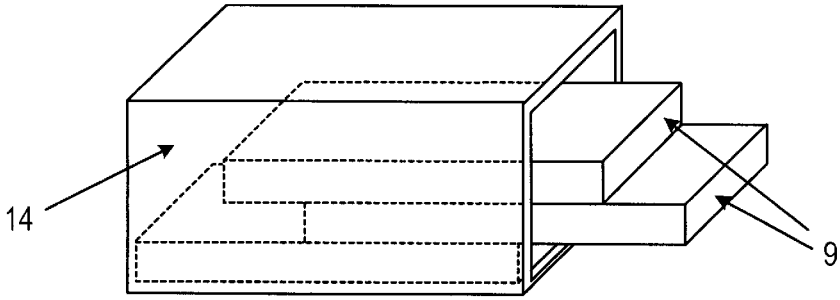

They may also be placed in boxes (14), stacking the cases (9) inside, as can be seen in FIG. 11.

The cases (9) may be arranged in an upright position, serving to support the pieces during the match, either separately or swinging by one of their edges on the tray.

These cases (9) may be placed in the boxes (14) or the trays (13), or be joined to them by means of matching devices or the like.

It is not considered necessary to prolong this description for any skilled person to understand the scope of the invention and the advantages to be derived from the same.

The materials, shape, size and arrangement of the elements will be liable to variation providing this does not involve any alteration of the essential nature of the invention.

The terms in which this specification is drawn up are to be taken always in a broad and non-restrictive sense.

What is claimed is:

1. A domino, comprising a plurality of pieces; an indication device provided on at least one side of said pieces and being different for said pieces; and a device for storing and transporting said pieces and including four cases each for situating seven of said pieces corresponding to each of four players.

2. A domino as defined in claim 1, wherein said indication device is formed so that it has several identifying positions.

3. A domino as defined in claim 1, wherein each of said indicating devices includes a window, and a disk which is turnable about an axis and upon turning displays different identifying characteristics through said window.

4. A domino as defined in claim 3, wherein said different identifying characteristics are characteristics selected from the group consisting of different references and different colors.

5. A domino as defined in claim 3, wherein said axis is formed by an axle starting from a spigot of an obverse of said piece.

6. A domino as defined in claim 1, wherein said indication devices are indication disks which have different characteristics.

7. A domino as defined in claim 6, wherein said different characteristics are characteristics selected from the group consisting of different colors and different reference sectors.

8. A domino as defined in claim 1, wherein said indication device is formed as a portion of each of said pieces, which is placeable in different positions.

9. A domino as defined in claim 8, wherein said portion is a square portion and placeable in four different positions.

10. A domino as defined in claim 1, wherein said indication device includes holes provided in said pieces on a back of said pieces, and identifying pegs receivable in said pieces.

11. A domino as defined in claim 1, wherein said indication device is integrated in a respective one of said pieces and does not protrude from a surface of said piece.

12. A domino as defined in claim 1, wherein said indication device includes slots provided in said pieces, and indication members slidable in said slots.

13. A domino as defined in claim 1, wherein each of said cases has at least one transparent side which allows viewing a corresponding side of said pieces situated in each of said cases.

14. A domino as defined in claim 1, wherein each of said cases has at least one side provided with at least one window for viewing a corresponding side of said pieces.

15. A domino as defined in claim 1, wherein said cases have different characteristics.

16. A domino as defined in claim 15, wherein said characteristics are characteristics selected from the group consisting of different references and different colors.

17. A domino as defined in claim 1, wherein each of said cases lacks at least one of its sides.

18. A domino as defined in claim 1, wherein each of said cases is formed so that it is placeable upright to form a support for said pieces of a corresponding player during a game.

19. A domino as defined in claim 1; and further comprising a container formed so that each of said cases is placeable inside said container.

20. A domino as defined in claim 19, wherein said container is formed as a container selected from the group consisting of a tray and a box.

* * * * *